US007285181B2

(12) United States Patent
Hu et al.

(10) Patent No.: US 7,285,181 B2
(45) Date of Patent: Oct. 23, 2007

(54) BLEACHING AND BRIGHTNESS STABILIZATION OF LIGNOCELLULOSIC MATERIALS WITH WATER-SOLUBLE PHOSPHINES OR PHOSPHONIUM COMPOUNDS

(75) Inventors: Thomas Qiuxiong Hu, Vancouver (CA); Brian R. James, Vancouver (CA); Dominggus Yawalata, Vancouver (CA); Maria B. Ezhova, Vancouver (CA)

(73) Assignees: FPInnovations, Pointe Claire, Québec (CA); University of British Columbia, Vancouver, British Columbia (CA)

( * ) Notice: Subject to any disclaimer, the term of this patent is extended or adjusted under 35 U.S.C. 154(b) by 304 days.

(21) Appl. No.: 10/770,474

(22) Filed: Feb. 4, 2004

(65) Prior Publication Data

US 2004/0173328 A1 Sep. 9, 2004

Related U.S. Application Data

(60) Provisional application No. 60/444,875, filed on Feb. 5, 2003.

(51) Int. Cl.
*D12H 17/10* (2006.01)
*D12H 21/32* (2006.01)
*D12H 21/38* (2006.01)

(52) U.S. Cl. ..... 162/80; 162/72; 162/76; 162/78; 162/82; 162/160

(58) Field of Classification Search ..... 162/70, 162/72, 80, 76, 78, 82, 160; 428/35.7; 562/35
See application file for complete search history.

(56) References Cited

U.S. PATENT DOCUMENTS 3,072,521 A * 1/1963 Samuelson et al. ..... 162/5
3,236,676 A 2/1966 Coates et al.
3,595,604 A * 7/1971 Evans et al. ..... 8/127.6
4,751,015 A * 6/1988 Humphreys et al. ..... 510/376
4,804,440 A 2/1989 Liebergott et al.
4,904,357 A * 2/1990 Sharifian et al. ..... 205/420
5,458,737 A * 10/1995 Diaddario, Jr. ..... 162/72
5,580,422 A * 12/1996 Hamilton et al. ..... 162/4
5,607,544 A * 3/1997 Salzburger et al. ..... 162/5
6,432,262 B1 * 8/2002 Ney et al. ..... 162/5

FOREIGN PATENT DOCUMENTS

GB 1401312 A * 7/1975
JP 55-22067 * 2/1980
WO WO 01/53602 7/2001

OTHER PUBLICATIONS

Journal of Wood Chemistry and Technology, 11(4), 419-437 (1991), "A Study of the Photoyellowing of Paper Made from Bleached CTMP", by R.S. Davidson et al.

* cited by examiner

*Primary Examiner*—Eric Hug
(74) *Attorney, Agent, or Firm*—Ogilvy Renault LLP

(57) ABSTRACT

A method for the bleaching and brightness stabilization of lignocellulosic materials is described. The method involves the treatment of lignocellulosic materials, in particular, (a) wood pulps such as thermomechanical pulps (TMP) and chemithermomechanical pulps (CTMP), and (b) papers made from wood pulps, with a water-soluble phosphine or a phosphonium compound preferably containing at least one phosphorus hydroxyalkyl bond/linkage, for example a phosphorus hydroxymethyl bond/linkage ($P—CH_2OH$). One example of such a water-soluble phosphine is the commercially available, tris(hydroxymethyl)phosphine (THP), $P(CH_2OH)_3$. One example of such a phosphonium compound is the commercially available, tetrakis(hydroxymethyl)phosphonium chloride (THPC), $[P(CH_2OH)_4]Cl$.

24 Claims, No Drawings

BLEACHING AND BRIGHTNESS STABILIZATION OF LIGNOCELLULOSIC MATERIALS WITH WATER-SOLUBLE PHOSPHINES OR PHOSPHONIUM COMPOUNDS

CROSS-REFERENCE TO RELATED APPLICATIONS

This application is related to U.S. Provisional Application Ser. No. 60/444,875 filed Feb. 5, 2003 and the benefit under 35 USC119(e) of such US Provisional Application is claimed.

BACKGROUND OF THE INVENTION

I) Field of the Invention

This invention relates to the field of lignocellulosic material production, in particular, to the bleaching and brightness stabilization of lignocellulosic materials.

II) Brief Description of the Prior Art

Lignocellulosic materials such as wood are the raw materials used for the production of pulps and papers. In order to make papers, lignocellulosic materials are first reduced to pulps of discrete fibres by a mechanical or chemical pulping process. In mechanical pulping, pulps are produced, with retention of lignin, mainly through the action of mechanical forces in a yield of 90-98%. One example of a mechanical pulp is the so-called thermomechanical pulp (TMP) produced from the thermomechanical pulping process. In chemical pulping, pulps are produced in a yield of 45-55% through the dissolution of most of the lignin by the pulping chemicals at an elevated temperature. The most dominant chemical pulp in use today is the so-called kraft pulp produced from the kraft pulping process where sodium hydroxide and sodium sulfide are used as the pulping chemicals.

Mechanical and chemical pulps typically have a pale-yellow and a deep brown colour, respectively. Bleaching of these pulps to a whiter colour is often needed prior to the process of papermaking. The whiteness of pulps and papers is commonly estimated by the ISO (International Standardization Organization) brightness determination, which measures the directional reflectance of light at 457 nm of the papers in an Elrepho instrument [*TAPPI Test Methods*, T 452 om-92, Tappi Press: Atlanta, 1996]. A low brightness such as 30% ISO indicates deep brown papers and a high brightness such as 85% ISO represents white papers. Unbleached mechanical wood pulps and chemical (kraft) pulps typically have ISO brightness values of 45-65% and 30-40%, respectively, depending on the wood species and the pulping conditions.

The current industrial processes for the bleaching of mechanical pulps are the alkaline hydrogen peroxide process and the sodium dithionite (hydrosulfite) process [Dence and Reeve, *Pulp Bleaching-Principles and Practice*, Tappi Press: Atlanta, p.457-512, 1996]. Alkaline hydrogen peroxide, in the presence of peroxide stabilizers such as sodium silicate and magnesium sulfate, is capable of bleaching mechanical pulps such as spruce TMP from an initial brightness of 55-60% to 70-80% ISO. However, alkaline peroxide bleaching, being an oxidative process, reduces the yield of the pulps by 2-5% and produces effluents with high chemical oxygen demand (COD) [Soteland et al., 1988 *International Pulp Bleaching Conference Proceedings*, Tappi Press: Altanta, p.231, 1988]. Sodium dithionite bleaching is a reductive and more selective process. However, it is less effective than alkaline hydrogen peroxide bleaching in terms of maximum brightness gain. The process normally needs to be carried out at a lower consistency to reduce the amount of air entrained in the pulps to minimize the oxidation of sodium dithionite during bleaching [Dence and Reeve, *Pulp Bleaching-Principles and Practice*, Tappi Press: Atlanta, p.500, 1996]. Consistency is the weight percentage of pulp in a pulp and water mixture; bleaching at a lower consistency requires the use of more water and is less desirable. In addition, some of the dithionite undergoes disproportionation during bleaching to give sodium bisulfite and sodium thiosulfate that is corrosive to paper machines [Garner, *J. Pulp Paper Sci.* 14(5): J51-57, 1984]. Both peroxide-bleached and dithionite-bleached pulps are highly unstable; they rapidly turn yellow with loss of the brightness gained from bleaching when exposed to light and/or heat or during storage [Leary, *J. Pulp Paper Sci.* 20(6): J154-160, 1994].

Partial or full bleaching of kraft pulps is currently accomplished with various oxidative bleaching chemicals such as oxygen, chlorine dioxide and ozone, and alkali extraction in several stages [Dence and Reeve, *Pulp Bleaching-Principle and Practice*, Tappi Press: Atlanta, p.213-361, 1996]. One problem with oxidative bleaching is a loss of pulp yield because of the low bleaching selectivity.

Alternative chemicals for the bleaching of lignocellulosic materials, particularly mechanical wood pulps, have been reported sporadically over the past twenty years or so. Bleaching of thermomechanical pulps has been achieved with thiol compounds [Kutney, *J. Pulp Paper Sci.* 12(4): J129-131, 1986], amino boranes [Pedneault, et al., *Pulp Paper Can.* 98(3): 51-54, 1997], and a spirophosphorane or a hypophosphorous acid [Djerdjouri and Robert, *Proceedings of 9th International Symposium on Wood and Pulping Chemistry,* 23-1-23-3, 1997]. Unfortunately, a very high dosage of these chemicals is needed to give a limited brightness gain. For example, 3.0% (on OD pulp) of ethanedithiol is needed to give a brightness gain of 6.0 ISO points. In addition, thiol compounds are too toxic and malodorous, and amino boranes too expensive to be used commercially.

Tris(hydroxymethyl)phosphine (THP), $P(CH_2OH)_3$, a water-soluble tertiary phosphine, has been used for the synthesis of water-soluble organometallic complexes [Ellis et al., *Inorg. Chem.* 31: 3026-3033, 1992; Higham, et al., *Chem. Commun.* 1107-1108, 1998]. Some of these complexes have also been used as catalysts for the catalytic hydrogenation of cinnamaldehyde and hydroformylation of pent-1-ene [Fujuoka et al., *Chem. Commun.* 489-490, 1999]. Quaternary phosphonium compounds such as tetrakis(hydroxymethyl)phosphonium chloride (THPC), $[P(CH_2OH)_4]Cl$ and tetrakis(hydroxymethyl)phosphonium sulfate (THPS), $[P(CH_2OH)_4]_2SO_4$ have been used as basic chemicals to make commercial flame(fire)-retardants for textiles [Calamari and Harper, in Kirk-Othmer Encyclopedia of Chemical Technology, 4th Ed. Vol. 10, 998-1022, 2000]. THPS has also been shown to be a non-hazardous biocide for the control of hydrogen sulfide emissions and the reduction of corrosion in paper mills [Haack et al., 1997 *Tappi Engineering & Papermakers Conference Proceedings*, Tappi Press: Atlanta, 1115-1119, 1997]. The ability of THP and THPS to kill catalase-producing bacteria in pulping liquors used for hydrogen peroxide bleaching of wood pulps has also been reported [Bowdery et al., PCT WO 01/53602 A1, 2001]. Water-sensitive, trimethyl phosphite, $P(OCH_3)_3$, has been reacted with mechanical wood pulps in anhydrous dichloromethane to allow the determination of o-quinones in the pulps by $^{31}P$ NMR [Lebo et al., *J. Pulp Paper Sci.* 16(5): J139-143, 1990; Argyropoulos et al., *Holzforschung* 46(3: 211-218, 1992]. When coated onto the surface of papers made from mechanical pulps, sodium hypophosphite, $H_2P(O)ONa$ [Violet et al., *Cellul. Chem. Technol.* 24: 225-235, 1990] and sodium hydroxymethylphosphinate, $HOCH_2P(O)(H)ONa$ [Guo and Gray, *J. Pulp Paper Sci.* 22(2): J64-70, 1996] have been shown to improve the brightness stability of papers.

U.S. Pat. No. 5,580,422 issued to Hoechst Celanese Corporation on Dec. 3, 1996 describes the brightening of color dyed wastepaper with a bleaching agent in the presence of a quaternary compound based on "nitrogen and phosphorous". All the quaternary compounds described contain at least one long-chain ($C_{14}$-$C_{22}$) alkyl or alkenyl group, or preferably one straight-chain hexadecyl ($C_{16}$) group. In addition, a known bleaching agent such as sodium hydrosulfite or hydrogen peroxide is required for the bleaching which is limited to pulp from color dyed wastepaper.

Prior to the present invention, however, no water-soluble phosphines or phosphonium compounds including THP, THPC and THPS have been used alone for the bleaching or brightness stabilization of lignocellulosic materials such as wood pulps and papers.

SUMMARY OF THE INVENTION

It is an object of this invention to provide a method of bleaching and brightness stabilization of a lignocellulosic material.

It is a further object of this invention to provide a lignocellulosic material, for example a pulp or paper in which the bleaching and brightness stabilization are achieved.

In accordance with one aspect of the invention there is provided a method of bleaching and brightness stabilization of a lignocellulosic material comprising treating the lignocellulosic material with a water-soluble phosphine or phosphonium compound of formula (A):

(A)

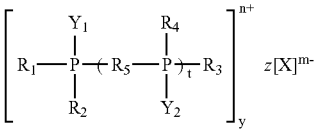

wherein t is zero or 1; when t=0, $R_4R_5PY_2$ is absent and $R_3$ is bonded to the P of the $R_1R_2PY_1$ group; $R_5$ is absent, an alkylene group $(CH_2)_s$ (s=1 to 12) interrupted by 0 to 6 oxygen (O) atoms or secondary amino (NR') groups, and/or substituted by a zero to 2s number of a hydroxyl, alkyl, aryl, thio, thioether, amino, ester, amide, carboxyl and/or carboxylate groups, or a phenylene group substituted by a zero to 4 number of a hydroxyl, alkyl, aryl, thio, thioether, amino, ester, amide, carboxyl, carboxylate, and/or sulfonate groups; or preferably $R_5$ is an alkylene group $(CH_2)_s$ (s=1 to 4) where the carbon chain is optionally interrupted by one or two oxygen (O) atom(s); $Y_1$ and $Y_2$ are both present or both absent, provided that when $Y_1$ and $Y_2$ are both absent, y=1, n=z=m=0 and X is absent, wherein when $Y_1$ and $Y_2$ are both absent, y=1, n=z=m=0, and X is absent, $R_1$, $R_2$ and $R_3$, or $R_1$, $R_2$, $R_3$, $R_4$ and $R_5$ groups are collectively selected such that the molecule has an overall solubility of at least 0.01 g/L; $R_1$, $R_2$ and $R_3$, or $R_1$, $R_2$, $R_3$ and $R_4$ are independently select from hydrogen, optionally substituted linear or branched alkyl groups, or optionally substituted aryl groups, the optional substitution referring to the presence of substituents selected from ether, amino, hydroxy, ester, thioether, amide, carbonyl, carboxyl, and carboxylate moieties, wherein when both $Y_1$ and $Y_2$ are present, X is an inorganic or organic anion, and the value of m is $\leqq 5$; the total charge of yn=zm; $Y_1$ is a hydroxymethyl group ($CH_2OH$); $R_1$, $R_2$ and $R_3$, or $R_1$, $R_2$, $R_3$, $R_4$ and $Y_2$ are independently selected from hydrogen, a Lewis acid such as boron trifluoride ($BF_3$), optionally substituted linear or branched alkyl groups, or optionally substituted aryl groups, the optional substitution referring to the presence of substituents selected from ether, amino, hydroxy, ester, thioether, amide, carbonyl, carboxyl, and carboxylate moieties.

In another aspect of the invention there is provided a lignocelullosic material bleached and brightness stabilized by a compound of formula (A) defined herein.

In another aspect of the invention there is provided a lignocelullosic material bleached and brightness stabilized by the method of the invention.

Thus it has now been discovered that bleaching and brightness stabilization of lignocellulosic materials such as wood pulps and papers can be achieved by treating the materials with a water-soluble phosphine such as tris(hydroxymethyl)phosphine (THP), $P(CH_2OH)_3$, or a phosphonium compound containing at least one phosphorus hydroxyalkyl bond/linkage, for example a phosphorus hydroxymethyl bond/linkage (P—$CH_2OH$) such as tetrakis (hydroxymethyl)phosphonium chloride (THPC), $[P(CH_2OH)_4]Cl$.

DETAILED DESCRIPTION OF THE INVENTION

The color of unbleached lignocellulosic materials such as unbleached wood pulps is known to be due mainly to the presence of lignin chromophores such as coniferaldehydes and o-quinones. During alkaline hydrogen peroxide bleaching, these chromophores are oxidatively removed via cleavage of the carbon-carbon double bonds (C═C). During sodium dithionite bleaching, the carbon-oxygen double bonds (C═O) in these chromophores are reduced [Dence and Reeve, *Pulp Bleaching-Principles and Practice*, Tappi Press: Atlanta, p.161-181, 1996].

One alternative way to reductively remove lignin chromophores and bleach lignocellulosic materials such as wood pulps is by hydrogenation of lignin C═C bonds, C═O bonds, and/or aromatic residues with dihydrogen ($H_2$) in the presence of a transition metal catalyst. During efforts to use a water-soluble, copper-tris(hydroxymethyl)phosphine (Cu-THP) complex as a catalyst for such a hydrogenation, it has been discovered that tris(hydroxymethyl)phosphine (THP) alone is capable of bleaching the pulps. It has also been unexpectedly discovered that a laboratory synthetic precursor to THP, tetrakis(hydroxymethyl)phosphonium chloride (THPC), also bleaches the pulps. The present invention is based on these surprising discoveries.

According to the present invention, bleaching and brightness stabilization of lignocellulosic materials such as mechanical wood pulps and papers can be achieved by treatment of the materials with a water-soluble phosphine, preferably a water-soluble tertiary phosphine; or a phosphonium compound, preferably a quaternary phosphonium compound. In a preferred embodiment the invention is the use of any phosphine or phosphonium compound that contains a P-Alk-OH fragment, such as a P—$CH_2$—OH fragment, wherein Alk indicates an alkylene radical which may be optionally substituted or interrupted as described herein.

Treatment or treating in the method of the invention particularly contemplates contacting the lignocellulosic material with a compound of formula (A) in an aqueous vehicle. The compound (A) reacts with or into the material to bleach the material thereby increasing the brightness and the compound (A) then stabilizes the brightness achieved.

The compounds of formula (A) have been broadly defined hereinbefore but in particular and preferred embodiments the compounds of formula (A) have the following characteristics:

a) $Y_1$ and $Y_2$ are both absent, $R_1$, $R_2$ and $R_3$, or $R_1$, $R_2$, $R_3$ and $R_4$ are independently hydrogen, an alkyl group (R) or an ether group (OR) with R being $(CH_2)_qH$ (q=1 to 12) interrupted by 0 to 6 oxygen (O) atoms or secondary amino (NR') groups, and/or substituted by a zero to (2q+1) number of a hydroxyl, thio, thioether, amino, ester, amide, carboxyl and/or carboxylate groups. R' is either hydrogen or an optionally substituted linear or branched alkyl group or optionally substituted aryl group; wherein optional substitution refers to the presence of one or more substituents selected from ether, amino, hydroxy, ester, thioether, amide, carbonyl, carboxyl, and carboxylate moieties;

b) $Y_1$ and $Y_2$ are both absent, $R_1$, $R_2$ and $R_3$, or $R_1$, $R_2$, $R_3$ and $R_4$ are independently hydrogen, an alkyl group (R) or an ether group (OR) with R being $CH_2(CH_2)_qH$ (q=0 to 5) interrupted by 0 to 3 oxygen (O) atoms or secondary amino (NR') groups, and/or substituted by a zero to (2q+1) number of a hydroxyl, thio, thioether, amino, ester, amide, carboxyl and/or carboxylate groups;

c) $Y_1$ and $Y_2$ are both absent, at least one of $R_1$ and $R_2$ is the same as $R_3$ in the molecule with $R_3$ being a hydroxymethyl ($CH_2OH$) group;

d) $Y_1$ and $Y_2$ are both absent, $R_1$, $R_2$ and $R_3$, or $R_1$, $R_2$, $R_3$ and $R_4$ are all hydroxymethyl ($CH_2OH$) groups;

e) $Y_1$ and $Y_2$ are present, $Y_1$ is a hydroxymethyl group ($CH_2OH$), $R_1$, $R_2$ and $R_3$, or $R_1$, $R_2$, $R_3$, $R_4$ and $Y_2$ are independently hydrogen, a Lewis acid such as boron trifluoride ($BF_3$), an alkyl group (R) or an ether group (OR) with R being $(CH_2)_qH$ (q=1 to 12) interrupted by 0 to 6 oxygen (O) atoms or secondary amino (NR') groups, and/or substituted by a zero to (2q+1) number of a hydroxyl, thio, thioether, amino, ester, amide, carboxyl and/or carboxylate groups. R' is either hydrogen or an optionally substituted linear or branched alkyl group or optionally substituted aryl group; wherein optional substitution refers to the presence of substituents selected from ether, amino, hydroxy, ester, thioether, amide, carbonyl, carboxyl, and carboxylate moieties;

f) $Y_1$ and $Y_2$ are present, $Y_1$ is a hydroxymethyl group ($CH_2OH$), $R_1$, $R_2$ and $R_3$, or $R_1$, $R_2$, $R_3$, $R_4$ and $Y_2$ are independently hydrogen, a Lewis acid such as boron trifluoride ($BF_3$), an alkyl group (R) or an ether group (OR) with R being $CH_2(CH_2)_qH$ (q=0 to 5) interrupted by 0 to 3 oxygen (O) atoms or secondary amino (NR') groups, and/or substituted by a zero to (2q+1) number of a hydroxyl, thio, thioether, amino, ester, amide, carboxyl and/or carboxylate groups;

g) $Y_1$ and $Y_2$ are present, $Y_1$ is a hydroxymethyl group ($CH_2OH$), and at least one of $R_3$, $R_4$ and $Y_2$ is a hydroxymethyl ($CH_2OH$) group.

In the phosphonium compounds of formula (A) X is suitably selected from chloride, sulfate, hydroxide, hydrosulfite, phosphate, carbonate, bicarbonate, bisulfate, alkoxide, formate, acetate, citrate, oxalate, ascorbate, ethylenediaminetetraacetate or diethylenetriaminepentaacetate.

The compounds of formula (A) for use in the invention need to be water-soluble and the variables in formula (A) are selected so that the compounds (A) have an overall water solubility of at least 0.01 g/L.

Further examples of preferred phosphine and phosphonium compounds for use in the invention are indicated below:

Phosphines:

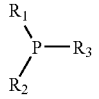

The $R_1$, $R_2$ and $R_3$ groups being collectively selected such that the molecule has an overall solubility of at least 0.01 g/L.

Where $R_1$ and/or $R_2$ are/is hydrogen; and $R_3$, $R_3$ and $R_1$, or $R_3$ and $R_2$, is/are selected from, optionally substituted linear or branch alkyl groups, or optionally substituted aryl groups; or $R_1$, $R_2$ and $R_3$ are independently selected from, optionally substituted linear or branched alkyl groups, or optionally substituted aryl groups. Where optional substitution can refer to the presence of substituents selected from ether, amino, hydroxy, ester, thioether, amide, carbonyl, carboxyl, and carboxylate moieties.

In a more preferred embodiment $R_1$, $R_2$ and $R_3$ are independently an alkyl group (R) or an ether group (OR) with R being $(CH_2)_qH$ (q=1 to 12) interrupted by 0 to 6 oxygen (O) atoms or secondary amino (NR') groups, and/or substituted by a zero to (2q+1) number of a hydroxyl, thio, thioether, amino, ester, amide, carboxyl and/or carboxylate groups.

In even more preferred embodiments $R_1$, $R_2$ and $R_3$ are independently an alkyl group (R) or an ether group (OR) with R being $CH_2(CH_2)_qH$ (q=0 to 5) interrupted by 0 to 3 oxygen (O) atoms or secondary amino (NR'), and/or substituted by a zero to (2q+1) number of a hydroxyl, thio, thioether, amino, ester, amide, carboxyl and/or carboxylate groups. R' is either hydrogen or an optionally substituted linear or branched alkyl group or optionally substituted aryl group. Where optional substitution can refer to the presence of substituents selected from ether, amino, hydroxy, ester, thioether, amide, carbonyl, carboxyl, and carboxylate moieties. In yet even more preferred embodiments at least one of $R_1$, $R_2$ and $R_3$ is a $CH_2OH$ group.

In a most preferred embodiment the water-soluble phosphine is the commercially available compound (from Strem), tris(hydroxymethyl)phosphine (THP), $P(CH_2OH)_3$. THP can also be readily synthesized from tetrakis(hydroxymethyl)phosphonium chloride (THPC), $[P(CH_2OH)_4]Cl$, in the laboratory according to a literature procedure [Ellis et al., *Inorg. Chem.* 31: 3026-3033, 1992].

Diphosphines and Bisphosphines:

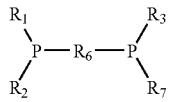

The $R_1$, $R_2$, $R_3$, $R_6$ and $R_7$ groups being collectively selected such that the molecule has an overall solubility of at least 0.01 g/L.

Where $R_1$, $R_2$, $R_3$ and $R_7$ are independently selected from hydrogen, optionally substituted linear or branched alkyl groups, or optionally substituted aryl groups. Where optional substitution can refer to the presence of substituents selected from ether, amino, hydroxy, ester, thioether, amide, carbonyl, carboxyl, and carboxylate moieties.

In more preferred embodiments the diphosphine compound is of $C_2$ or CS symmetry. In preferred embodiments $R_1$, $R_2$, $R_3$ and $R_7$ are independently hydrogen, an alkyl group (R) or an ether group (OR) with R being $(CH2)_qH$ (q=1 to 12) interrupted by 0 to 6 oxygen (O) atoms or secondary amino (NR') groups, and/or substituted by a zero to (2q+1) number of a hydroxyl, thio, thioether, amino, ester, amide, carboxyl and/or carboxylate groups. R' is either hydrogen or an optionally substituted linear or branched alkyl group or optionally substituted aryl group. Where optional substitution can refer to the presence of substituents selected from ether, amino, hydroxy, ester, thioether, amide, carbonyl, carboxyl, and carboxylate moieties. In more preferred embodiments $R_1$, $R_2$, $R_3$ and $R_7$ are independently hydrogen, an alkyl group (R) or an ether group (OR) with R being $CH_2(CH_2)_qH$ (q=0 to 5) interrupted by 0 to 3 oxygen (O) atoms or secondary amino (NR') groups, and/or substituted by a zero to (2q+1) number of a hydroxyl, thio, thioether, amino, ester, amide, carboxyl and/or carboxylate groups.

In even more preferred embodiments at least one of $R_1$ and $R_2$ is the same as $R_3$ in the molecule. In yet even more preferred embodiments at least one of $R_1$ and $R_2$ is the same as $R_3$ in the molecule with $R_3$ being a hydroxymethyl ($CH_2OH$) group. In most preferred embodiments $R_1$, $R_2$, $R_3$ and $R_7$ are all hydroxymethyl ($CH_2OH$) groups.

$R_6$ is absent; an alkylene group $(CH_2)_s$ (s=1 to 12) interrupted by 0 to 6 oxygen (O) atoms or secondary amino (NR') groups, and/or substituted by a zero to 2s number of a hydroxyl, alkyl, aryl, thio, thioether, amino, ester, amide, carboxyl and/or carboxylate groups; or a phenylene group substituted by a zero to 4 number of a hydroxyl, alkyl, aryl, thio, thioether, amino, ester, amide, carboxyl, carboxylate, and/or sulfonate groups.

In preferred embodiments $R_6$ is an alkylene group $(CH_2)_s$ (s=1 to 4), where the carbon chain is optionally interrupted by one or two oxygen (O) atom(s).

Phosphonium Compounds.

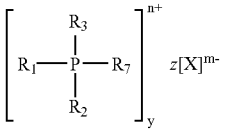

wherein X is an inorganic or organic anion such as, but not limited to, chloride, sulfate, hydroxide, hydrosulfite, phosphate, carbonate, bicarbonate, bisulfate, alkoxide, formate, acetate, citrate, oxalate, ascorbate, ethylenediaminetetraacetate or diethylenetriaminepentaacetate, and the value of m is ≦5; the total charge of yn=zm.

Where $R_3$ is a hydroxymethyl group ($CH_2OH$); and $R_1$, $R_2$ and $R_7$ are independently selected from hydrogen, a Lewis acid such as boron trifluoride ($BF_3$), optionally substituted linear or branched alkyl groups, or optionally substituted aryl groups. Where optional substitution can refer to the presence of substituents selected from ether, amino, hydroxy, ester, thioether, amide, carbonyl, carboxyl, and carboxylate moieties.

In preferred embodiments $R_3$ is a hydroxymethyl group ($CH_2OH$); and $R_1$, $R_2$ and $R_7$ are independently hydrogen, a Lewis acid such as boron trifluoride ($BF_3$), an alkyl group (R) or an ether group (OR) with R being $(CH_2)_qH$ (q=1 to 12) interrupted by 0 to 6 oxygen (O) atoms or secondary amino (NR') groups, and/or substituted by a zero to (2q+1) number of a hydroxyl, thio, thioether, amino, ester, amide, carboxyl and/or carboxylate groups. R' is either hydrogen or an optionally substituted linear or branched alkyl group or optionally substituted aryl group. Where optional substitution can refer to the presence of substituents selected from ether, amino, hydroxy, ester, thioether, amide, carbonyl, carboxyl, and carboxylate moieties. In more preferred embodiments $R_3$ is a hydroxymethyl group ($CH_2OH$); and $R_1$, $R_2$ and $R_7$ are independently hydrogen, a Lewis acid such as boron trifluoride ($BF_3$), an alkyl group (R) or an ether group (OR) with R being $CH_2(CH_2)_qH$ (q=0 to 5) interrupted by 0 to 3 oxygen (O) atoms or secondary amino (NR') groups, and/or substituted by a zero to (2q+1) number of a hydroxyl, thio, thioether, amino, ester, amide, carboxyl and/or carboxylate groups.

In a most preferred embodiment the phosphonium compound is either the commercially available salt (from Aldrich), tetrakis(hydroxymethyl)phosphonium chloride (THPC), $[P(CH_2OH)_4]Cl$, or tetrakis(hydroxymethyl)phosphonium sulfate (THPS), $[P(CH_2OH)_4]_2SO_4$.

Diphosphonium and Bisphosphonium Compounds

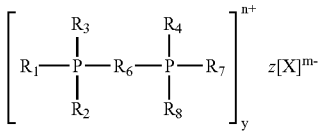

wherein X is an inorganic or organic anion such as, but not limited to, chloride, sulfate, hydroxide, hydrosulfite, phosphate, carbonate, bicarbonate, bisulfate, alkoxide, formate, acetate, citrate, oxalate, ascorbate, ethylenediaminetetraacetate or diethylenetriaminepentaacetate, and the value of m is ≦5; the total charge of yn=zm.

Where $R_3$ is a hydroxymethyl group ($CH_2OH$); and $R_1$, $R_2$, $R_4$, $R_7$ and $R_8$ are independently selected from hydrogen, a Lewis acid such as boron trifluoride ($BF_3$), optionally substituted linear or branched alkyl groups, or optionally substituted aryl groups. Where optional substitution can refer to the presence of substituents selected from ether, amino, hydroxy, ester, thioether, amide, carbonyl, carboxyl, and carboxylate moieties.

In more preferred embodiments the diphosphonium compound is of $C_2$ or $C_s$ symmetry.

In preferred embodiments $R_3$ is a hydroxymethyl group ($CH_2OH$); and $R_1$, $R_2$, $R_4$, $R_7$ and $R_8$ are independently hydrogen, a Lewis acid such as boron trifluoride ($BF_3$), an alkyl group (R) or an ether group (OR) with R being $(CH_2)_qH$ (q=1 to 12) interrupted by 0 to 6 oxygen (O) atoms or secondary amino (NR') groups, and/or substituted by a zero to (2q+1) number of a hydroxyl, thio, thioether, amino, ester, amide, carboxyl and/or carboxylate groups. R' is either hydrogen or an optionally substituted linear or branched alkyl group or optionally substituted aryl group. Where optional substitution can refer to the presence of substituents selected from ether, amino, hydroxy, ester, thioether, amide, carbonyl, carboxyl, and carboxylate moieties. In more preferred embodiments $R_3$ is a hydroxymethyl group ($CH_2OH$); and $R_1$, $R_2$, $R_4$, $R_7$ and $R_8$ are independently hydrogen, a Lewis acid such as boron trifluoride ($BF_3$), an alkyl group (R) or an ether group (OR) with R being $CH_2(CH_2)_qH$ (q=0 to 5) interrupted by 0 to 3 oxygen (O) atoms or secondary amino (NR') groups, and/or substituted by a zero to (2q+1) number of a hydroxyl, thio, thioether, amino, ester, amide, carboxyl and/or carboxylate groups.

In most preferred embodiments $R_3$ is a hydroxymethyl group ($CH_2OH$); and at least one of $R_4$, $R_7$ and $R_8$ is also a hydroxymethyl ($CH_2OH$) group.

$R_6$ is absent; an alkylene group $(CH_2)_s$ (s=1 to 12) interrupted by 0 to 6 oxygen (O) atoms or secondary amino (NR') groups, and/or substituted by a zero to 2s number of a hydroxyl, alkyl, aryl, thio, thioether, amino, ester, amide, carboxyl and/or carboxylate groups; or a phenylene group substituted by a zero to 4 number of a hydroxyl, alkyl, aryl, thio, thioether, amino, ester, amide, carboxyl, carboxylate, and/or sulfonate groups.

In preferred embodiments $R_6$ is an alkylene group $(CH_2)_s$ (s=1 to 4), where the carbon chain is optionally interrupted by one or two oxygen (O) atom(s).

Especially preferred compounds of formula (A) for use in the invention include;

tris(hydroxymethyl)phosphine (THP), $P(CH_2OH)_3$;

tris(hydroxypropyl)phosphine(THPP), $P(CH_2CH_2CH_2OH)_3$;

bis[bis(hydroxymethyl)phosphino]ethane, $(HOCH_2)_2PCH_2CH_2P(CH_2OH)_2$;

tetrakis(hydroxymethyl)phosphonium chloride (THPC), $[P(CH_2OH)_4]Cl$;

tetrakis(hydroxymethyl)phosphonium sulfate (THPS), $[P(CH_2OH)_4]_2SO_4$; and

3-[tris(hydroxymethyl)phosphonium]propionate, $(CH_2OH)_3P^+—CH_2CH_2COO^-$.

Unless indicated otherwise terms indicated hereinafter have the following meanings in this specification:

i) alkyl and alkyl moieties are straight chain or branched and have 1 to 12, preferably 1 to 6 and more preferably 1 to 4 carbon atoms; alkyl moieties contemplates the alkyl portions of thioether, amide, ether and ester substituents;

ii) aryl and aryl moieties and arylene have 6 to 14 carbon atoms and are preferably phenyl or phenylene; aryl moieties contemplates the aryl portions of thioether, amide, ether and ester substituents;

iii) water soluble means, with reference to the compounds of formula (A) that the compounds have an overall water solubility of at least 0.01 g/L.

iv) bleaching and brightness stabilization refers to bleaching of the lignocellulosic material to give the material a higher brightness value, and providing the material with a higher brightness stability against light, heat and/or storage. In other words, bleaching and brightness stabilization refers to bleaching of the material, and stabilizing the brightness of the material resulting from the bleaching.

v) when a compound of formula (A) bleaches the lignocellulosic material it reacts with and/or into the lignocellulosic material, the material is thereby bleached. Furthermore, the brightness of the material is stabilized against light, heat and/or storage by the compound (A) which thus serves both to bleach the material and to stabilize the brightness achieved by the bleaching.

Method of Use

Treatment of lignocellulosic materials such as wood chips, pulps and papers with the said phosphine or phosphonium compounds of formula (A) can be carried out on chips, pulp or paper over a consistency of 0.01 to 99% in a pH range of 3.0-12.0 and a temperature range of 20-170° C. at various places during the manufacturing and processing of the pulp or paper, such as the impregnation or refining of wood chips in an impregnator or refiner, bleaching of the pulp in a bleach tower or any other vessels, and surface sizing or coating of papers in a size press or coater. The consistency may, in particular be 40-99%

The amount of the phosphine or the phosphonium compound can suitably range from 0.01 to 6.0% by weight based on oven-dried (OD) chip/pulp/fibre weight, preferably at least 0.05%, more preferably at least 0.1% and most preferably from 0.2 to 3.0%, by weight. The treatment can take place over the course of between 5 minutes and 30 days.

Treatment of lignocellulosic materials with the said phosphine or phosphonium compounds can also be incorporated into a known, reductive bleaching such as, but not limited to, the sodium dithionite bleaching of the lignocellulosic materials.

The treatment may typically be carried out in a single-stage or multi-stage in one or more than one bleach tower, pulp mixer, storage vessel, agitated tank or any other stock preparation vessels of a paper machine, or any other vessels suitable for performing the treatment of the pulp.

The invention contemplates the bleaching and brightness stabilization of lignocellulosic materials such as wood pulps and papers, the pulps and papers containing the said bleached pulps and/or having the said improved brightness stability.

The lignocellulosic mechanical wood pulp may, for example be spruce TMP or aspen CTMP.

Paper in the present specification also includes paperboard.

The lignocellulosic material may be, for example, a mechanical wood pulp that has been partially or fully bleached with other bleaching chemicals such as alkaline hydrogen peroxide and/or sodium dithionite; or a chemical wood pulp such as unbleached kraft pulp or kraft pulp partially or fully delignified and/or bleached with other delignifying and/or bleaching chemicals such as oxygen and/or chlorine dioxide.

The lignocellulosic material may also be a paper sheet containing mechanical wood pulp as the sole pulp component or as one of the pulp components.

It has also been found advantageous to treat the lignocellulosic materials treated with the said phosphines or phosphonium compounds with: (a) an organic or inorganic yellowing inhibitor such as a benzotriazole or benzophenone ultraviolet absorber (UVA), titanium dioxide particulate sunscreen, or a hindered hydroxyamine radical scavenger (RS), (b) a polymeric yellowing inhibitor such as poly (ethylene glycol) or poly(vinyl pyrrolidone), and/or (c) a metal chelating agent such as diethylenetriaminepentaacetic acid (DTPA), to further improve the brightness stability of the materials.

This invention also covers the pulp or paper produced by the use of the methods and compositions described herein.

EXAMPLES

The present invention is illustrated by, but not limited to, the following examples:

General Procedure A: Treatment of Wood Pulps with a Water-soluble Phosphine or a Phosphonium Compound Unless otherwise specified, the wood pulp is chelated with diethylenetriaminepentaacetic acid (DTPA), pentasodium salt (0.6% on OD pulp) at 50° C., pH 5.0 and 1.5% consistency for 30 min to remove metal ions [Ali et al., *J. Pulp Paper Sci.,* 12(6): J166-172, 1986]. For treatment of the pulp at <5% consistency, the said water-soluble phosphine or phosphonium compound (0.01-6.0% on OD pulp) is dissolved in a small amount of deionized water and mixed with the pulp in a beaker to give an appropriate consistency. The pH of the pulp slurry is adjusted to a desired value (pH 3.0-12.0) by addition of a small amount of NaOH or diluted $H_2SO_4$ solution. For treatment at consistency ≧5%, a pulp slurry with a consistency of 1.5% is prepared and its pH adjusted to a desired value (pH 3.0-12.0) by addition of a small amount of NaOH or diluted $H_2SO_4$ solution. The pulp is filtered, thickened, and mixed with a solution of the said phosphine or phosphonium compound (0.01-6.0% on OD pulp) in deionized water, the pH of which has also been adjusted to the same pH as the pulp slurry, to give an appropriate consistency. For treatment at <100° C., the mixture of the pulp and the said phosphine or phosphonium compound is transferred into a polyethylene bag. The bag is sealed and immersed in a hot water-bath set at a desired temperature for a known period of time. For treatment at ≧100° C. and ≦130° C., the mixture is transferred into an Erlenmeyer flask, placed inside a bench-top autoclave (Brinkmann 2540M), and heated at a desired temperature for a known period of time. For treatment at >130° C., the mixture is transferred into a Pyrex liner (762HC2, Parr Instrument Co.) and placed inside a pressure reactor (4560 Mini Bench Top Reactor, Parr Instrument Co.). The reactor is sealed and heated at a desired temperature for a known period of time. At the end of the treatment, the polyethylene bag is removed and cooled in a cold water-bath to room temperature (~20° C.), or the autoclave or reactor is cooled to room temperature and the Erlenmeyer flask or Pyrex liner removed. The pulp mixture is diluted with deionized water to 0.5 to 1.0% consistency, filtered and washed with deionized water. The filtered pulp is again diluted with deionized water, the mixture stirred and filtered. The % ISO brightness values of the pulps treated with or without the said phosphine or phosphonium compound are measured on handsheets (200 g/m $^2$) prepared according to PAPTAC Test Method, Standard C.5, and on a Technibrite Micro TB-1C instrument according to TAPPI Test Methods, T525 om-02 (except that only a single ply of a 200 g/m$^2$ handsheet is used over a black background).

General Procedure B: Treatment of Papers with a Water-soluble Phosphine or a Phosphonium Compound A handsheet (200 g/m$^2$) from a lignocellulosic pulp is prepared and its % ISO brightness measured. Two square (7.0×7.0 cm) sheets are cut from the handsheet. Unless otherwise specified, the said phosphine or phosphonium compound (0.01-6.0% on OD fibres) dissolved in 1.4 mL of deionized water is applied evenly to a square sheet using a syringe. The sheet is set aside in a constant temperature (23° C.) and humidity (50%) room for a known period of time and the % ISO brightness of the sheet measured.

General Procedure C: Ambient Office Light Exposure of Papers

Ambient office light exposure of the square sheets that have been or have not been treated with the said phosphine or phosphonium compound, or portions of the handsheets made from wood pulps that have been or have not been treated with the said phosphine or phosphonium compound, is carried out by placing the sheets on an office desk under normal, cool-white fluorescent office lights at a distance of about six feet with the lights being on 24 hours a day. Unless otherwise specified, the light intensity for such ambient office light exposure is measured to be 82±2 foot-candle. Measurements of the % ISO brightness of the sheets are done at different time intervals.

General Procedure D: Heat and Moisture Exposure of Papers

Heat and moisture exposure of handsheets made from wood pulps that have been or have not been treated with the said phosphine or phosphonium compound is carried out by placing one fourth of each of the handsheets on a sample holder inside a SH-220S3 benchtop temperature & humidity chamber (ESPEC CORP. Grand Rapids, Mich., USA). The temperature and humidity of the chamber are set at 80° C. and 65% relative humidity unless otherwise specified. Measurements of the % ISO brightness of the sheets are done at different time intervals.

Example 1

Chelated spruce TMP (% ISO brightness=58.2) was treated with 1.0% (on OD pulp) of tris(hydroxymethyl) phosphine (THP) at 1.5% consistency, 90° C. for 3 h at various pHs according to the general procedure A disclosed above. Table 1 shows the increases of the ISO brightness of the pulps after treatment with THP over a wide pH range.

TABLE 1

% ISO Brightness of the Spruce TMP after Treatment with 1.0% (on OD pulp) of THP at Various pHs

| pH | % ISO Brightness |
|---|---|
| 4.3 ± 0.2 | 64.8 |
| 5.3 ± 0.2 | 64.7 |
| 6.3 ± 0.2 | 64.0 |
| 7.3 ± 0.2 | 64.3 |
| 8.3 ± 0.2 | 64.2 |
| 9.3 ± 0.2 | 63.6 |
| 10.3 ± 0.2 | 62.5 |

Example 2

Chelated spruce TMP (% ISO brightness=58.2) was treated with 1.0% (on OD pulp) of THP at 90° C., pH 5.3±0.2 for 3 h at various consistencies according to the general procedure A disclosed above. Table 2 shows that bleaching of the pulps by the said treatment can be achieved at various consistencies.

TABLE 2

% ISO Brightness of the Spruce TMP after Treatment with THP at Various Consistencies

| Consistency (%) | % ISO Brightness |
|---|---|
| 1.5 | 64.7 |
| 5.0 | 65.0 |
| 10 | 64.9 |
| 20 | 64.6 |

Example 3

Chelated spruce TMP (% ISO brightness=58.2) was treated with 1.0% and 2.0% (on OD pulp) of tetrakis (hydroxymethyl)phosphonium chloride (THPC) (from Aldrich), $[P(CH_2OH)_4]Cl$, and tetraethylphosphonium chloride (TEPC) (from Aldrich), $[P(CH_2CH_3)_4]Cl$, respectively, at 1.5% consistency, 90° C., pH 5.3±0.2 for 3 h according to the general procedure A disclosed above. Table 3 shows that bleaching of the pulp can be achieved by treatment with THPC, but not with TEPC—a quaternary phosphonium compound containing no phosphorus hydroxymethyl bond/linkage (P—$CH_2OH$).

TABLE 3

| % ISO Brightness of the Spruce TMP after Treatment with THPC and TEPC | | |
|---|---|---|
| Amount of the phosphonium compound (% on OD pulp) | % ISO Brightness of the THPC-treated Pulp | % ISO Brightness of the TEPC-treated Pulp |
| 1.0 | 62.5 | 57.7 |
| 2.0 | 64.4 | 57.5 |

Example 4

Chelated spruce TMP (% ISO brightness=58.2) was treated with 2.0% (on OD pulp) of bis[tetrakis(hydroxymethyl)phosphonium] sulfate (THPS) (from Aldrich), $[P(CH_2OH)_4]_2SO_4$, at 1.5% consistency, pH 5.3±0.2, and 90 and 130° C., respectively, for 3 h according to the general procedure A disclosed above. Sample of the same chelated spruce TMP was also treated with 2.0% (on OD pulp) of THPS at 1.5% consistency, pH 5.3±0.2 and 150° C. for 5 min according to the general procedure A disclosed above. Table 4 shows that bleaching of the pulp can be readily achieved by treatment with THPS over a wide temperature range.

TABLE 4

| % ISO Brightness of the Spruce TMP after Treatment with THPS | | |
|---|---|---|
| Treated at 90° C. for 3 h | Treated at 130° C. for 3 h | Treated at 150° C. for 5 min |
| 64.8 | 65.8 | 62.1 |

Example 5

Chelated spruce TMP (% ISO brightness=58.2) was bleached with 2.0% (on OD pulp) of sodium dithionite at 4.0% consistency, 60° C., pH 6.0 for 2 h, with 2.0% (on OD pulp) of THP at 5.0% consistency, 90° C., pH 5.3±0.2 for 3 h according to the general procedure A disclosed above, and with alkaline peroxide (5.0% hydrogen peroxide, 4.0% NaOH, 3.0% $Na_2SiO_3$ and 0.05% $MgSO_4$, all on OD pulp) at 20% consistency, 60° C. for 3 h, respectively. Portions of these three bleached pulps were further bleached with 2.0% (on OD pulp) of THP and 2.0% (on OD pulp) of sodium dithionite, respectively. Table 5 shows the brightness values of the various bleached pulps obtained using sodium dithionite, THP and alkaline peroxide as the bleaching agents, alone and in combination. THP can be used to bleach the pulp alone or in combination with dithionite or peroxide. When combined with peroxide, THP provides a higher brightness increase to the pulp than does dithionite.

TABLE 5

| % ISO Brightness of the Spruce TMP after Bleaching with Dithionite, Peroxide and THP, alone and in Combination | |
|---|---|
| Pulp | % ISO Brightness |
| Dithionite-bleached | 66.0 |
| THP-bleached | 66.0 |
| Peroxide-bleached | 76.9 |
| Dithionite-bleached, THP-bleached | 68.6 |
| THP-bleached, dithionite-bleached | 68.6 |

TABLE 5-continued

| % ISO Brightness of the Spruce TMP after Bleaching with Dithionite, Peroxide and THP, alone and in Combination | |
|---|---|
| Pulp | % ISO Brightness |
| Peroxide-bleached, THP-bleached | 79.2 |
| Peroxide-bleached, dithionite-bleached | 77.8 |

Example 6

Softwood (SW), oxygen and chlorine dioxide delignified, and oxygen and peroxide-reinforced alkaline-extracted (ODoEop) kraft pulp (KP) (% ISO brightness=66.7), was treated with 2.0% (on OD pulp) of THPC at 1.5% consistency, pH 5.3±0.2 at various temperatures for 3 h according to the general procedure A disclosed above. Table 6 shows that bleaching of the kraft pulp can also be readily achieved by treatment with THPC at various temperatures.

TABLE 6

| % ISO Brightness of the SW ODoEop KP after Treatment with 2.0% (on OD pulp) of THPC | |
|---|---|
| Treatment temperature (° C.) | % ISO Brightness |
| 90 | 71.6 |
| 110 | 72.4 |
| 130 | 72.2 |

Example 7

Chelated spruce TMP (% ISO brightness=58.2) was treated with 3.0% (on OD pulp) of THP at 1.5% consistency, 90° C., pH 5.3±0.2 for 3 h according to the general procedure A disclosed above. The filtrate from the treatment was used to treat a new batch of the same chelated spruce TMP. Table 7 shows that the filtrate can be recycled and used for the bleaching of the pulp again.

TABLE 7

% ISO Brightness of the Spruce TMP after Treatment with 3.0% (on OD pulp) of THP, and after Treatment with the Filtrate

| Pulp | % ISO Brightness |
|---|---|
| THP-treated | 65.9 |
| Recycled filtrate-treated | 64.9 |

Example 8

Two square (7.0×7.0 cm) sheets cut from handsheets of chelated spruce TMP (% ISO brightness=58.4) and of chelated aspen CTMP (% ISO brightness=62.1) were treated with 2.0% (on OD fibres) of THPC dissolved in 1.0 mL of deionized water according to the general procedure B disclosed above. Table 8 shows the ISO brightness values measured on both sides of the sheets before treatment with THPC and after treatment with THPC and storage at room temperature (~20° C.) for various times. Bleaching of the sheets can be achieved by treatment of the sheets with THPC at room temperature with a higher brightness gain at a longer bleaching time.

TABLE 8

% ISO Brightness (One Side/the Other side) of the Untreated Spruce TMP and Aspen CTMP Sheets and the Sheets Treated with THPC and Stored for Various Times

| Treatment | Storage time after treatment | % ISO brightness of spruce TMP | % ISO brightness of aspen CTMP |
|---|---|---|---|
| no | — | 58.4/58.2 | 62.6/62.1 |
| yes | 3 h | 62.5/62.0 | 66.2/65.9 |
| yes | 6 h | 63.1/62.4 | 66.6/66.4 |
| yes | 1 day | 64.0/63.1 | 67.4/67.3 |
| yes | 2 days | 64.5/63.4 | 67.8/67.9 |
| yes | 3 days | 65.0/63.8 | 68.2/68.2 |
| yes | 4 days | 65.3/64.1 | 68.5/68.5 |
| yes | 7 days | 65.9/64.6 | 68.9/69.1 |
| yes | 9 days | 66.1/64.8 | 69.1/69.4 |
| yes | 14 days | 66.4/65.2 | 69.5/69.6 |

Example 9

Four square (7.0×7.0 cm) sheets cut from handsheets of aspen BCTMP (% ISO brightness=81.7) were treated with: (a) 0.5% (on OD fibres) of an ultraviolet absorber (UVA), 2-hydroxybenzophenone (Aldrich) dissolved in 1.4 mL of ethanol, (b) 1.0% (on OD fibres) of THPC dissolved in 1.4 mL of deionized water according to the general procedure B disclosed above, and (c) both 0.5% (on OD fibres) of the UVA and 1.0% (on OD fibres) of THPC dissolved in a mixture of 1.0 mL of ethanol and 0.4 mL of deionized water. Table 9 lists the brightness values of the untreated aspen BCTMP sheet and the three treated sheets, as well as the brightness values of the sheets after they have been exposed to an ambient office light according to the general procedure C disclosed above. Higher brightness stabilization of the aspen BCTMP sheet can be obtained by treatment of the sheet with the said phosphonium compound and an ultraviolet absorber (UVA).

TABLE 9

% ISO Brightness of the Untreated Aspen BCTMP Sheet, the BCTMP Sheets Treated with UVA, THPC, and with UVA and THPC before and after Exposure to Ambient Office Light

| Light exposure time (days) | Untreated BCTMP | Treated with UVA | Treated with THPC | Treated with UVA & THPC |
|---|---|---|---|---|
| 0 | 81.7 | 81.2 | 83.6 | 83.5 |
| 2 | 80.4 | 80.5 | 83.1 | 83.5 |
| 5 | 79.2 | 79.9 | 82.5 | 83.3 |
| 7 | 78.7 | 79.6 | 82.1 | 83.2 |
| 9 | 78.2 | 79.4 | 81.5 | 82.9 |
| 13 | 77.0 | 78.7 | 80.1 | 81.8 |
| 16 | 76.2 | 78.2 | 78.8 | 80.9 |
| 19 | 75.5 | 77.9 | 78.0 | 80.2 |

Example 10

Chelated spruce TMP (% ISO brightness=58.2) was bleached, respectively, with 1.5% (on OD pulp) of sodium dithionite at 4.0% consistency, 90° C., pH 6.0 for 2 h, with 0.6% $H_2O_2$, 0.5% NaOH, 1.0% $Na_2SiO_3$ and 0.05% $MgSO_4$ (all on OD pulp) at 60° C. for 3 h, and with 2.5% (on OD pulp) of THPS at 1.5% consistency, 130° C., pH 5.3±0.2 for 3 h according to the general procedure A disclosed above. Sheets from the TMP pulp, and the TMP pulps bleached/treated with sodium dithionite, alkaline hydrogen peroxide, and THPS were exposed to heat and moisture according to the general procedure D disclosed above except that 99° C. and 99% relative humidity were employed. Table 10 lists the brightness values of the sheets before and after the heat and moisture exposure. Treatment of the TMP pulp with THPS not only significantly bleaches the pulp, but it also provides the pulp with much higher brightness stability than pulps bleached to similar initial brightness with either sodium dithionite or alkaline hydrogen peroxide.

TABLE 10

% ISO Brightness of the Sheets Made from the TMP Pulp, and from the TMP Pulps Bleached/Treated with Sodium Dithionite, Alkaline Hydrogen Peroxide, and THPS before and after Exposure to Heat (99° C.) and Moisture (99% RH)

| Heat and moisture exposure time (h) | TMP | TMP bleached with sodium dithionite | TMP bleached with alkaline hydrogen peroxide | TMP treated with THPS |
|---|---|---|---|---|
| 0 | 58.2 | 66.3 | 65.9 | 65.9 |
| 0.5 | 57.6 | 62.9 | 63.2 | 64.5 |
| 1.0 | 57.3 | 61.8 | 62.3 | 64.0 |
| 2.0 | 56.7 | 60.4 | 60.6 | 63.1 |
| 3.0 | 56.1 | 59.4 | 59.7 | 62.3 |

Example 11

Two square (7.0×7.0 cm) sheets cut from a handsheet of aspen BCTMP (% ISO brightness=83.2) were treated with 1.0% and 2.0% (on OD fibres) of tris(hydroxypropyl)phosphine (THPP) (from Strem), $P(CH_2CH_2CH_2OH)_3$, according to the general procedure B disclosed above. Table 11 lists the brightness values of the untreated aspen BCTMP square sheet and the two square sheets treated with THPP, respectively, as well as the brightness values of the sheets after they have been exposed to an ambient office light according to the general procedure C disclosed above. Significant bleaching and brightness stabilization of the aspen BCTMP sheet can be readily obtained by the said treatment.

TABLE 11

% ISO Brightness of the Untreated Aspen BCTMP Sheet and the BCTMP Sheets Treated with 1.0% and 2.0% (OD fibres) of THPP before and after Exposure to Ambient Office Light

| Light exposure time (days) | Untreated aspen BCTMP | BCTMP treated with 1.0% of THPP | BCTMP treated with 2.0% of THPP |
|---|---|---|---|
| 0 | 83.2 | 85.1 | 85.0 |
| 3 | 81.3 | 83.4 | 83.3 |
| 7 | 79.9 | 82.4 | 82.5 |
| 12 | 78.5 | 81.4 | 81.6 |
| 17 | 77.0 | 80.1 | 80.7 |
| 21 | 76.1 | 79.1 | 79.9 |
| 26 | 74.6 | 77.7 | 78.8 |
| 31 | 73.5 | 76.7 | 77.8 |
| 35 | 72.6 | 75.9 | 77.0 |
| 40 | 71.6 | 74.9 | 76.2 |
| 45 | 70.7 | 74.0 | 75.3 |
| 49 | 69.9 | 73.3 | 74.5 |

Example 12

Chelated spruce TMP (% ISO brightness=58.6) was treated at 1.5% consistency, pH 5.3±0.2 for 3 h at 90 and at 110° C. according to the general procedure A disclosed above with 2.5% (on OD pulp) of a zwitterionic phosphonium compound, 3-[tris(hydroxymethyl)phosphonium]propionate, $(CH_2OH)_3P^+—CH_2CH_2COO^-$, prepared from the reaction of tris(hydroxymethyl)phosphine, $(CH_2OH)_3P$, and acrylic acid, $CH_2{=}CHCOOH$. The same chelated spruce TMP was also treated with at 1.5% consistency, pH 5.3±0.2 for 3 h at 90° C. according to the general procedure A disclosed above with 2.0% (on OD pulp) of a bisphosphine, 1,2-bis[bis(hydroxymethyl)phosphino]benzene, $(HOCH_2)_2PC_6H_4P(CH_2OH)_2$, prepared according to a literature procedure [Ready et al., *Inorg. Chim. Acta* 240: 367-370, 1995]. Table 12 shows the increases of the ISO brightness of the pulps after treatment with the zwitterionic phosphonium compound and the bisphosphine.

TABLE 12

% ISO Brightness of the Spruce TMP after Treatment with 2.5% (on OD pulp) of the zwitterionic phosphonium compound or 2.0% (on OD pulp) of the bisphosphine

| Phosphorus compound | Treatment temperature (° C.) | % ISO Brightness |
|---|---|---|
| $(CH_2OH)_3P^+—CH_2CH_2COO^-$ | 90 | 65.2 |
| $(CH_2OH)_3P^+—CH_2CH_2COO^-$ | 110 | 66.9 |
| $(HOCH_2)_2PC_6H_4P(CH_2OH)_2$ | 90 | 64.4 |

Example 13

Chelated spruce TMP (% ISO brightness=58.4) was treated at 1.5% consistency, pH 5.3±0.2 and 110° C. for 3 h according to the general procedure A disclosed above with various amounts (on OD pulp) of a bisphosphine, bis[bis(hydroxymethyl)phosphino]ethane (abbreviated as BBHPE), $(HOCH_2)_2PCH_2CH_2P(CH_2OH)_2$ prepared according to a literature procedure [Ready et al., *Inorg. Chim. Acta* 240: 367-370, 1995]. Table 13 shows the increases of the ISO brightness of the pulps after treatment with various amounts of BBHPE.

TABLE 13

% ISO Brightness of the Spruce TMP after Treatment with Various Amounts of BBHPE

| Amount of BBHPE (% on OD pulp) | % ISO Brightness |
|---|---|
| 0 | 58.4 |
| 1.0 | 66.6 |
| 2.0 | 69.5 |
| 4.0 | 71.4 |

Example 14

Chelated spruce TMP (% ISO brightness 58.1) was bleached at 60° C. and 20% consistency for 3 h with 3.0% $H_2O_2$, 2.4% NaOH, 1.8% $Na_2SiO_3$ and 0.05% $MgSO_4$, with 5.0% $H_2O_2$, 4.0% NaOH, 3.0% $Na_2SiO_3$ and 0.05% $MgSO_4$, and with 8.0% $H_2O_2$, 7.0% NaOH, 3.0% $Na_2SiO_3$ and 0.05% $MgSO_4$, respectively, to give three alkaline hydrogen peroxide-bleached pulps abbreviated as $P_{3.0\%}$, $P_{5.0\%}$ and $P_{8.0\%}$, respectively. Two of the alkaline hydrogen peroxide-bleached pulps, $P_{3.0\%}$ and $P_{5.0\%}$, were further bleached at 1.5% consistency, pH 5.3±0.2 and 110° C. for 3 h according to the general procedure A disclosed above with 2.0% (on OD pulp) of BBHPE, $(HOCH_2)_2PCH_2CH_2P(CH_2OH)_2$. Table 14 shows the ISO brightness values of the various alkaline hydrogen peroxide-bleached pulps and the pulps sequentially bleached with alkaline hydrogen peroxide and BBHPE. Sequential bleaching of the pulp with alkaline hydrogen peroxide and BBHPE gives the bleached pulp with higher brightness than bleaching with alkaline hydrogen peroxide alone, even though the charge of alkaline hydrogen peroxide for the sequential bleaching is much lower than that for the bleaching with alkaline hydrogen peroxide alone.

TABLE 14

% ISO Brightness of the Spruce TMP Bleached with Various Amounts of Alkaline Hydrogen Peroxide, and Bleached Sequentially with Alkaline Hydrogen Peroxide and BBHPE

| Bleaching Sequence | % ISO Brightness |
|---|---|
| $P_{3.0\%}$ | 73.0 |
| $P_{5.0\%}$ | 76.4 |
| $P_{8.0\%}$ | 78.5 |
| $P_{3.0\%}$ followed by 2.0% BBHPE | 78.7 |
| $P_{5.0\%}$ followed by 2.0% BBHPE | 80.1 |

We claim:

1. A method of bleaching and brightness stabilization of a lignocellulosic pulp comprising:

i) bleaching the lignocellulosic pulp, in an aqueous medium with a water-soluble phosphine or phosphonium compound of formula (A):

(A)

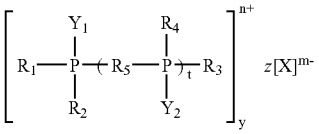

wherein t is zero or 1;

when t=0, $R_4R_5PY_2$ is absent and $R_3$ is bonded to the P of the $R_1R_2PY_1$ group;

when t=1, $R_5$ is absent such that there is a P—P bond, or $R_5$ is an alkylene group $(CH_2)_s$ (s=1 to 12) interrupted by 0 to 6 oxygen (O) atoms or secondary amino (NR') groups, and/or substituted by a zero to 2s number of a hydroxyl, alkyl, aryl, thio, thioether, amino, ester, amide, carboxyl and/or carboxylate groups, or a phenylene group substituted by a zero to 4 number of a hydroxyl, alkyl, aryl, thio, thioether, amino, ester, amide, carboxyl, carboxylate, and/or sulfonate groups;

m is an integer of 0 to 5 and y is an integer of 1 or more, and n and z are integers of 0 or more such that yn=zm;

when y=1, and n=z=m=0, then X is absent;

$R_1$, $R_2$ and $R_3$, or $R_1$, $R_2$, $R_3$, $R_4$ and $R_5$ groups are collectively selected such that said compound of formula (A) has an overall solubility of at least 0.01 g/L;

$R_1$, $R_2$ and $R_3$, or $R_1$, $R_2$, $R_3$ and $R_4$ are independently selected from hydrogen, optionally substituted linear or branched alkyl groups, or optionally substituted aryl groups, the optional substitution being the presence of substituents selected from ether, amino, hydroxy, ester, thioether, amide, carbonyl, carboxyl, and carboxylate moieties; and $Y_1$ and $Y_2$ are independently absent or a carboxylate moiety; or when X is present, X is an inorganic or organic anion, and the value of m is ≦5; the total charge of yn=zm; and $Y_1$ is a hydroxymethyl group ($CH_2OH$); $R_1$, $R_2$ and $R_3$, or $R_1$, $R_2$, $R_3$, $R_4$ and $Y_2$ are independently selected from hydrogen, boron trifluoride ($BF_3$), optionally substituted linear or branched alkyl groups, or optionally substituted aryl groups, the optional substitution being the presence of substituents selected from ether, amino, hydroxy, ester, thioether, amide, carbonyl, carboxyl, and carboxylate moieties; and ii) stabilizing the brightness in the resulting bleached lignocellulosic pulp with said compound of formula A of said bleaching in step i).

2. A method according to claim 1 wherein $Y_1$ and $Y_2$ are both absent, $R_1$, $R_2$ and $R_3$, or $R_1$, $R_2$, $R_3$ and $R_4$ are independently hydrogen, an alkyl group (R) or an ether group (OR) with R being $(CH2)_qH$ (q=1 to 12) interrupted by 0 to 6 oxygen (O) atoms or secondary amino (NR') groups, and/or substituted by a zero to (2q+1) number of a hydroxyl, thio, thioether, amino, ester, amide, carboxyl and/or carboxylate groups, R' is either hydrogen or an optionally substituted linear or branched alkyl group or optionally substituted aryl group; wherein optional substitution refers to the presence of one or more substituents selected from ether, amino, hydroxy, ester, thioether, amide, carbonyl, carboxyl, and carboxylate moieties.

3. A method according to claim 1, wherein $Y_1$ and $Y_2$ are both absent, $R_1$, $R_2$ and $R_3$, or $R_1$, $R_2$, $R_3$ and $R_4$ are independently hydrogen, an alkyl group (R) or an ether group (OR) with R being $CH_2(CH_2)_qH$ (q=0 to 5) interrupted by 0 to 3 oxygen (O) atoms or secondary amino (NR') groups, and/or substituted by a zero to (2q+1) number of a hydroxyl, thio, thioether, amino, ester, amide, carboxyl and/or carboxylate groups.

4. A method according to claim 1, wherein $Y_1$ and $Y_2$ are both absent, at least one of $R_1$ and $R_2$ is the same as $R_3$ in the molecule with $R_3$ being a hydroxymethyl ($CH_2OH$) group.

5. A method according to claim 1, wherein $Y_1$ and $Y_2$ are both absent, $R_1$, $R_2$ and or $R_1$, $R_2$, $R_3$ and $R_4$ are all hydroxymethyl ($CH_2OH$) groups.

6. A method according to claim 1, wherein $Y_1$ is a hydroxymethyl group ($CH_2OH$), $R_1$, $R_2$ and $R_3$, or $R_1$, $R_2$, $R_3$, $R_4$ and $Y_2$ are independently hydrogen, boron trifluoride ($BF_3$), an alkyl group (R) or an ether group (OR) with R being $(CH_2)_qH$ (q=1 to 12) interrupted by 0 to 6 oxygen (O) atoms or secondary amino (NR') groups, and/or substituted by a zero to (2q+1) number of a hydroxyl, thio, thioether, amino, ester, amide, carboxyl and/or carboxylate groups, R' is either hydrogen or an optionally substituted linear or branched alkyl group or optionally substituted aryl group; wherein optional substitution refers to the presence of substituents selected from ether, amino, hydroxy, ester, thioether, amide, carbonyl, carboxyl, and carboxylate moieties.

7. A method according to claim 1, wherein $Y_1$ is a hydroxymethyl group ($CH_2OH$), $R_1$, $R_2$ and $R_3$, or $R_1$, $R_2$, $R_3$, $R_4$ and $Y_2$ are independently hydrogen, boron trifluoride ($BF_3$), an alkyl group (R) or an ether group (OR) with R being $CH_2(CH_2)_qH$ (q=0 to 5) interrupted by 0 to 3 oxygen (O) atoms or secondary amino (NR') groups, and/or substituted by a zero to (2q+1) number of a hydroxyl, thio, thioether, amino, ester, amide, carboxyl and/or carboxylate groups.

8. A method according to claim 1, wherein X is selected from chloride, sulfate, hydroxide, hydrosulfite, phosphate, carbonate, bicarbonate, bisulfate, alkoxide, formate, acetate, citrate, oxalate, ascorbate, ethylenediaminetetraacetate or diethylenetriaminepentaacetate.

9. A method according to claim 1, wherein $Y_1$ is a hydroxymethyl group ($CH_2OH$), and at least one of $R_3$, $R_4$ and $Y_2$ is a hydroxymethyl ($CH_2OH$) group.

10. A method according to claim 1 wherein said compound is the phosphine tris(hydroxymethyl)phosphine (THP), $P(CH_2OH)_3$.

11. A method according to claim 1 wherein said compound is the phosphine tris(hydroxypropyl)phosphine (THPP), $P(CH_2CH_2CH_2OH)_3$.

12. A method according to claim 1 wherein said compound is the phosphine bis[bis(hydroxymethyl)phosphino] ethane, $(HOCH_2)_2PCH_2CH_2P(CH_2OH)_2$.

13. A method according to claim 1 wherein said compound is the phosphonium compound tetrakis(hydroxymethyl)phosphonium chloride (THPC), $[P(CH_2OH)_4]Cl$.

14. A method according to claim 1 wherein said compound is the phosphonium compound tetrakis(hydroxymethyl)phosphonium sulfate (THPS), $[P(CH_2OH)_4]_2SO_4$.

15. A method according to claim 1 wherein said compound is the phosphonium compound 3-[tris(hydroxymethyl)phosphonium]propionate, $(CH_2OH)_3P^+$—$CH_2CH_2COO^-$.

16. A method according to claim 1 wherein said lignocellulosic pulp is a mechanical wood pulp.

17. A method according to claim 16 wherein said lignocellulosic mechanical wood pulp is spuce TMP or aspen CTMP.

18. A method according to claim 1 wherein the said lignocellulosic pulp is a mechanical wood pulp that has been partially or fully bleached with alkaline hydrogen peroxide and/or sodium dithionite.

19. A method according to claim 1 wherein the said lignocellulosic pulp is a chemical wood pulp partially or fully delignified and/or bleached with oxygen and/or chlorine dioxide.

20. A method according to claim 1 wherein the bleaching and brightness stabilization are conducted in said aqueous medium at a pH of 2.0-12.0, a temperature of 20-170° C. and a consistency of 0.01-99% for 5 minutes to 30 days with a charge of the phosphorus compound being 0.01 to 6.0%, by weight, based on the oven-dry (OD) weight of the lignocellulosic pulp.

21. A method according to claim 1 wherein the bleaching and brightness stabilization are conducted at a temperature of 20-170° C. and a consistency of 40-99% for 5 minutes to 30 days with a charge of the phosphorus compound being 0.01 to 6.0%, by weight, based on the oven-dry (OD) weight of the lignocellulosic pulp.

22. A method according to claim 1 wherein the bleaching and brightness stabilization are carried out in a single-stage or multi-stage in one or more than one bleach tower, pulp mixer, a storage vessel, an agitated tank or any other stock preparation vessels of a paper machine, or any other vessels suitable for performing the bleaching and brightness stabilization of the lignocellulosic pulp.

23. A method according to claim 1, wherein the pulp is also treated with: (a) a benzotriazole, benzophenone or titanium dioxide ultraviolet absorber (UVA), or a hindered hydroxyamine radical scavenger (RS), (b) a poly(ethylene glycol) or poly(vinyl pyrrolidone) yellowing inhibitor, and/or (c) a metal chelating agent.

24. A method according to claim 1, wherein the lignocellulosic pulp is additionally bleached with sodium dithionite.

* * * * *